United States Patent [19]

Abramson et al.

[11] Patent Number: 4,821,437

[45] Date of Patent: Apr. 18, 1989

[54] MERCHANDISE INFORMATION SYSTEM

[76] Inventors: Patrick B. Abramson, 304-365 Kennedy Rd., S., Brampton, Ontario, Canada, L6W 3H3; Willem J. Bake, P.O. Box 6464, Mississauga, Ontario, Canada, L4W 9Z9

[21] Appl. No.: 719,963

[22] Filed: Apr. 4, 1985

[51] Int. Cl.[4] ..... G09F 3/18

[52] U.S. Cl. ..... 40/642; 40/651

[58] Field of Search ..... 40/11 R, 10 R, 16.4, 40/16.2, 617, 13, 19.5, 124; 186/55, 35; 211/116; 312/234.1, 234.5, 234.2

[56] References Cited

U.S. PATENT DOCUMENTS

| | | | |
|---|---|---|---|
| 1,393,136 | 10/1921 | Johnson | 40/19.5 |
| 1,844,444 | 2/1932 | Schoolcraft | 40/11 R |
| 2,032,533 | 3/1936 | Garfinkle | 40/16.4 |
| 3,877,163 | 4/1975 | Bissonet | 40/16.4 |
| 3,889,408 | 6/1975 | Offner | 40/10 R |
| 3,945,467 | 3/1976 | Levitz | 186/35 |
| 3,958,788 | 5/1976 | Feibelman | 40/16.2 |
| 4,140,224 | 2/1979 | Celeste | 40/16.2 |
| 4,335,863 | 6/1982 | Rapps | 40/11 R |
| 4,531,311 | 7/1985 | Howard et al. | 40/10 R |
| 4,557,064 | 12/1985 | Thompson | 40/11 R |
| 4,587,752 | 5/1986 | Swamy | 40/124 |
| 4,654,988 | 4/1987 | Ericksen | 40/19.5 |

*Primary Examiner*—Gene Mancene
*Assistant Examiner*—Cary E. Stone
*Attorney, Agent, or Firm*—John P. Synder

[57] ABSTRACT

A plurality of display items each having on opposite sides thereof information concerning available merchandise at a remote location. A support includes a rigid base including integral mounting flanges. A plurality of spaced flexible webs are formed integral with the lower edge of the base and depend therefrom. The display items are attached to the lower ends of the webs to display one side of the items. The flexible webs permit a customer to swing the item upwardly about the flexible web to view the opposite side of the item. The base also includes an upwardly facing channel for receiving the lower ends of display items to support the items in upstanding relation thereto.

31 Claims, 4 Drawing Sheets

MERCHANDISE INFORMATION SYSTEM

BACKGROUND OF THE INVENTION

Attractive, open display of an abundance of merchandise, conductive of favorable purchasing decisions whether or not a patron is assisted by a salesperson, is potentially at odds with limiting inventory costs, reducing the amount of warehousing and other handling, controlling pilferage, and limiting losses attributable to shop worn or out-of-date merchandise. A variety of responses have occurred in response to these problems.

One direction taken has been to install an increasing number of security systems at the retail location including means of surveillance and alarm systems. This, however, addresses only the problem of shrinkage attributable to pilferage and tends to create an atmosphere of distrust not conducive to selling.

Another direction taken has been toward limiting the merchandise displayed, as for example in the number of catalog showrooms that have arisen in recent years. This tackles the problems of inventory size, handling, and losses due to out-of-date merchandise, while usually exposing only a single item to wear-and-tear or possible theft while on showroom display.

BRIEF SUMMARY OF THE INVENTION

The present invention eliminates the need for exhibition of the merchandise to the public at the retail location, but instead affords information via display of product information modules—cards, packets, or similar tactile elements of durable design and material that attractively advertise availability of the product at that outlet and inform the clientele with respect to the product. It substitutes mass display of each item carried with mass display of such information modules, in an array providing high density but individually visible display. And, as will be evident in the particular embodiment described and in the detailed description of the invention, it substitutes physical examination of a particular sample with physical manipulation of the product information module, but without requiring a comparable level of handling by store personnel and without requiring dedication of a comparable amount of floor space.

In short, the invention contemplates the provision of support means for holding information display means in the form of items or modules having information on front and back sides thereof in high density but individually visible concentration while allowing each and any module to be manipulated by a prospective customer for ready visual access to all the information provided thereon.

The support means provided by the invention comprises an extrusion with which the information display means is so associated that the information is readily accessible. In a preferred embodiment, the support means includes flexible attachment means for permitting the manipulation of the information display means. The support means can be an elongate extrusion mountable on a wall or other surface in a position to allow viewing of the information display means or product information modules. The support means comprises a relatively rigid support having the flexible attachment means connected thereto. The flexible attachment means preferably comprises a plurality of flexible strips extending from the support and having free ends that terminate in attaching means adapted to grip the information display means.

One class of merchandise for which the invention is particularly adapted is that of prerecorded video tapes. Presently tapes of concerts, motion pictures, or the like are distributed with a cassette housing provided with pictures and other labelling that identify the contents, artists, producers, and such other possible aids to selection as plot synopsis, critical acclaims, and awards. A retailer may store the cassette packages on shelves accessible to the public or maintain them behind a counter, in which case the sales impact of the labelling is substantially reduced. If offering the tapes for rent, the cassette is often removed and the housing only displayed on shelving, requiring that the housing be brought to the checkout counter and tape and housing matched. The alternative practice of openly displaying cassette and housing together, or perhaps cassette with specialized housing, requires a good deal of confidence in the store's other security measures. All of the above practices have drawbacks that are overcome by such application of time, space or restrictive practices that purveying of such tapes has been primarily limited to specialty stores.

Application of the invention would permit attractive displays for video cassettes marketed with or without cassette housings. Information that now goes on the housing package would be placed on the product information module, employing space on the front and back of the module. The modules need not be packaged together with each video tape, but could be supplied to the retailer by an authorized distributor. They would be attached to a series of elongate support elements in an individually hinged manner as taught by the invention. A customer would make his selection at the array presented, being able to view the modules, read information contained thereon front or back by turning it on its hinge, and obtain his selection at the checkout having access to the actual cassette. Encoded slips may be supplied at the location of the product information module for use at the checkout, or some other means of relating customer selection may be employed.

BRIEF DESCRIPTION OF THE DRAWING FIGURES

DETAILED DESCRIPTION OF THE INVENTION

Figure 1:
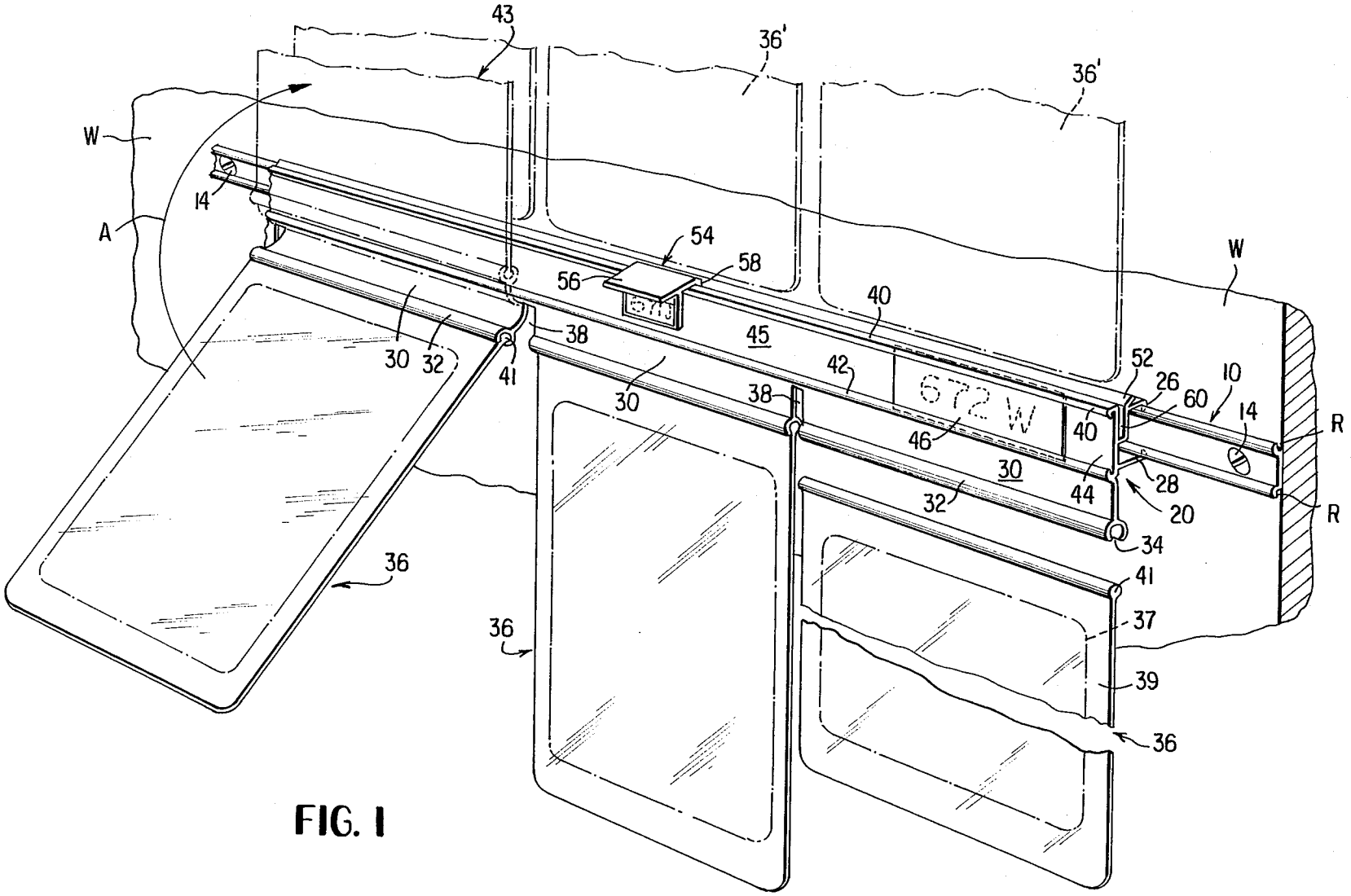
FIG. 1 is a perspective view of part of a display system in accordance with a preferred embodiment of the invention.

Reference is now made to FIG. 1 of the drawings which shows part of an information display system in accordance with a preferred embodiment of the invention. A preferred support of this invention in the form of a rail 10 made of synthetic resin or plastic material is secured to a wall W by horizontally spaced screws 14. With additional reference to FIG. 3, the rail 10 has integral upper and lower ribs 16 and 18 respectively which define spaces or recesses R between such ribs 16, 18 and the wall W into which the lips 26' and 28' of the support means 20 are snapped or slid. The support means 20 is of relatively complex cross-section, being extruded into such form and having different portions 24, 24' and 24'' possessing different mechanical properties for reasons which will be explained hereinafter.

The portion 24 includes the upper and lower flanges 26 and 28 having the aforesaid ribs 26' and 28' which are received in the spaces R, R. The flanges are spaced apart so as respectively to snap fit over the ribs 16 and 18 of the plastic rail 10. The portion 24 is made of relatively rigid plastic or synthetic resinous material and is extruded integrally with the portion 24' which is relatively flexible and is in turn extruded integrally with the portion 24''. The portion 24'' is less flexible than the portion 24' but more flexible than the portion 24. These mechanical properties of the several portions are achieved by introducing the materials having the requisite, corresponding properties side-by-side in the extrusion process.

The portion 24 forms an elongate support for an array of the product information display means 36 so that a prospective customer may view the information on the front side of each item attached to the support 24. Each display means is capable of being manipulated by swinging it upwardly as indicated by the arrow A to the dotted line position 43, the information on the reverse side of the means 36 then being accessible to the prospective customer. The flexible attachment means provided by the portions 24' and 24'' permit this manipulation. It will be noted that portion 24' comprises a flexible member 30 in the form of a web. The portions 24' and 24'' are divided into a plurality of individual attachment means that extend serially the length of the support 24, cumulatively commensurate in length with the support 24 and accordingly of an individual length fractional thereto. The notches 38 separate the individual attachment means, formed of the aforesaid portions 24' and 24'', each from its neighboring individual attachment means. It will be apparent that the notches 38 are made after extrusion of the continuous support means 20. The free ends of the individual attachment means 24'' are formed into tubular clips 32 of C-shaped cross sections provided by the slots 34 extending the length of each clip 32.

Each product information display means 36 is of generally rectangular configuration and comprises a graphics card 37 or two such graphics cards or sheets which provide all the requisite information about the video tape, which graphics cards are enclosed or encased in the clear plastic envelope 39. The side or face of the display means 36 which is normally exposed to the customer's view will usually be provided with the title and an attractive picture and the reverse side of the display means facing the wall will usually be provided with more detailed information about the corresponding video tape. The plastic envelope 39 is preferably sealed to provide the information display means in packet form. Further, this packet includes the tubular bead 41 which is slightly larger in diameter than the interior of tubular clip 32. When the bead 41 is inserted into the tubular clip 32 either by forcing it through the slot 34 or by sliding it lengthwise into the clip 32, an attachment between the product information packet 36 and support means 20 is effected which permits the packet to be manipulated so that its reverse side may be viewed by the prospective customer, as permitted by flexure of the flexible portion 24'. The spacing of the notches 38 and lengths of the tubular clips 32 is limited to the width of the packets 36, to allow each packet to be manipulated without interfering with the orientation of neighboring packets or information display means.

In FIG. 1, it will be appreciated that, because each information display means 36 is swung upwardly such as indicated by reference character 43, information on the back of the packet will have to lie head to toe to that on the front of the label to permit it to be easily read. Also, it will be noted that when the packet is released, it will simply fall to the original position as shown by the central display means 36 in FIG. 1. If for any reason a particular display means 36 must be replaced, same may be done either by snapping it out of its tubular clip 32 with a sharp pull or by sliding it out lengthwise of the clip 32. Another display means 36 may then be slid or snapped into the clip 32, and thus may the product information display means 36 be replaced or rearranged at will. It will also be appreciated that FIG. 1 illustrates in phantom lines the lower portions of display means 36' carried by a further support means as illustrated in FIG. 4.

Figure 3:
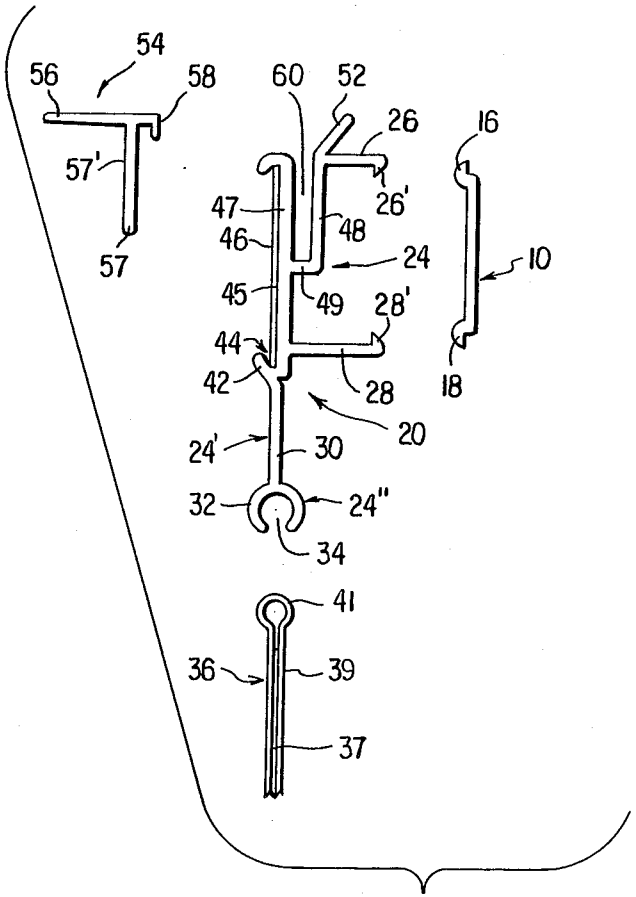
FIG. 3 is an exploded end view, drawn to a larger scale, of elements that may be brought together in the preferred embodiment.
Figure 4:
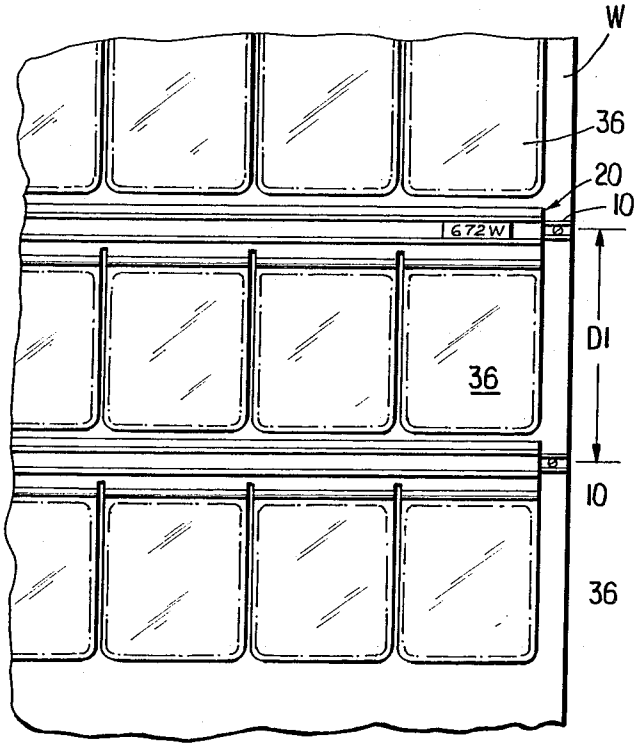
FIG. 4 is a front view of an assembled display system in accordance with the preferred embodiment of the invention.

In order to assemble the display system as shown in FIG. 4, the rails 10 are first spaced apart vertically at a distance D1 such that when the product information means 36 are mounted as shown in FIG. 4 each such means can be freely raised to view its reverse side. In FIG. 4, all display cards hang from the tubular clips 32 and none are inserted into the channel 60. Once the spacing has been set and the rails 10 secured, the support means 20 can be cut to size and slid into place. The product information modules 36 can next be sorted and arranged and then inserted into their appropriate positions by use of the tubular clips 32. Finally, other labelling or indicia 46 may be applied to the surface 45. In addition or alternatively, product identification label carriers 54 may be used. FIG. 3 illustrates the construction of such carriers wherein it will be seen that each carrier comprises a vertical web 57 providing a front surface 57' to which the labelling may be applied, a front overhang 56 for ease of grasping, and a hook portion 58 which allows the carrier to be hung over the top edge of the web 47. The carriers may be taken by a customer and handed in to the sales clerk.

The front side of the elongate support 24 is provided with two forwardly projecting and mutually convergent ribs, 40 and 42, that define, with the front face 45, a wide shallow channel 44 extending the length of the support means 20 and within which labels such as indicated at 46 can be placed to contain further information such as identification of the product advertised by a corresponding display means 36.

Still referring to FIGS. 1 and 3. the upstanding portion 48 is joined to the web 47 by the bight 49 to define an upwardly opening channel 60, said channel being dimensioned so that additional product information means 36 or other ancillary display information may be inserted thereinto. The ramp 52 projects upwardly and rearwardly from the upper edge of the portion 48 to assure easy insertion of such elements into the channel 60.

Figure 2:
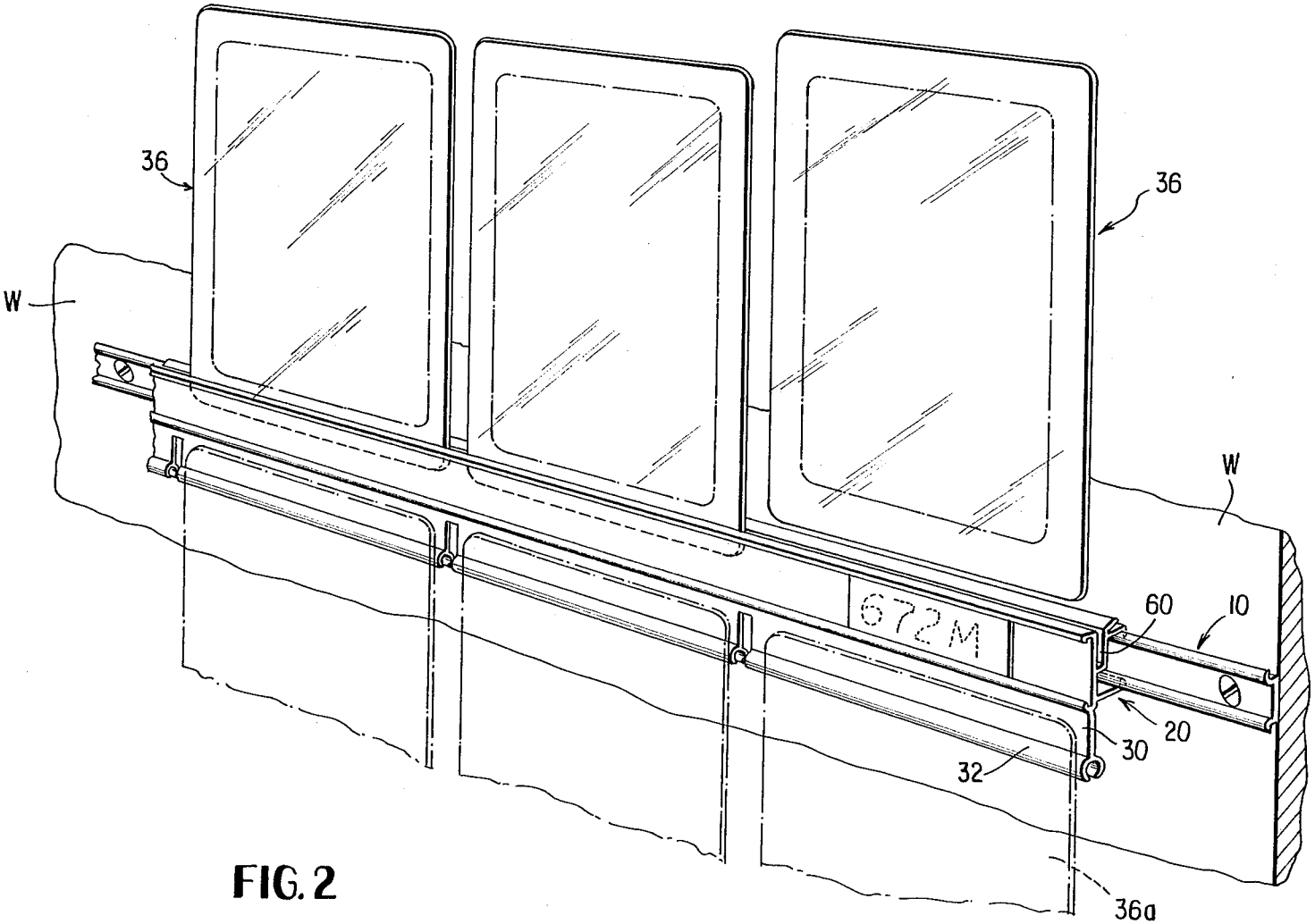
FIG. 2 is a perspective view similar to FIG. 1 indicating an alternative functionality of the preferred embodiment.
Figure 5:
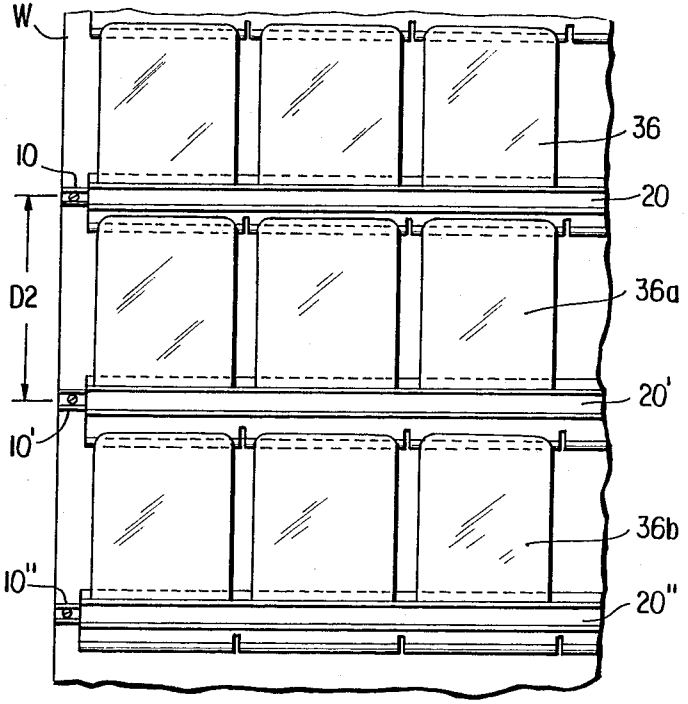
FIG. 5 is a front view similar to FIG. 4 indicating the alternative functionality also shown in FIG. 2.

FIGS. 2 and 5 illustrate more clearly the alternative display arrangement described above involving the use of the channel 60 but without the use of the flexible attaching means 24', 24". Instead, a vertically spaced series of support means 20, 20' and 20" are attached to the wall W through the intermediary of the supports 10, 10' and 10". The spacing D2 between the supports is such that the display means 36, **36*a* and 36*b* associated with the several support means 20, 20' and 20" receive the display means 36, 36*a* and 36*b* with a higher density than is the case where, as in FIG. 4, the means 36 are all associated with the flexible attachment means 24', 24" as was described with relation to FIGS. 1 and 3. This higher density is achieved by virtue of the fact that since the portions 24' and 24"** are not used, they may be overlapped by the display means as shown.

Figure 6:
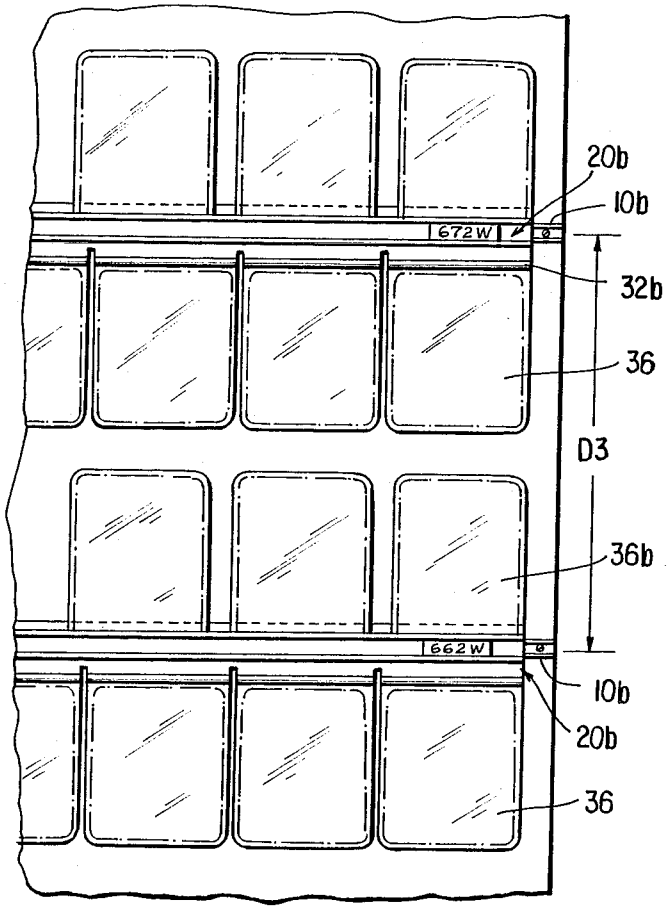
FIG. 6 is a front view of a wall mounted information display system in accordance with the preferred embodiment of the invention and employing additionally the alternative functionality of FIGS. 2 and 5.

With reference to FIG. 6, it will be appreciated that the capacity of each support means can be doubled by a spacing D3 and use of both the tubular clips **32*b* and channel 60 previously described to display both the suspended product information means 36 and the channel-received means 36*b*. The suspended means will of course have to be equipped with the edge bead 41 to hang from the clips 32*b* whereas the channel-received means 36*b*** do not require such beads.

Various modifications may be made to the embodiments hereinbefore described. The invention may be practiced in display, information, or exhibit contexts other than a retail outlet. The support means could be secured other than through a cooperative rail element. Orientations other than horizontal may be employed. Surfaces to which the system is attached may have fixed, moveable, or other characteristics. For example, the support elements for modules below a comfortable viewing height could be suspended on vertical strips formed of a flexible material so that they could be lifted to examine modules attached thereto. In addition, attachment means other than tubular clips could be employed. Or the clips could be given smaller, fractional lengths to permit retention of modules in a range of sizes.

The invention is not limited to the particular embodiment disclosed or suggested variants thereof. Its scope is properly determined and is made apparent by the appended claims.

What is claimed is:

1. A merchandise identification system comprising a plurality of display items at a first location sufficiently remote from a second location having available merchandise so that a customer at the first location does not have access to the merchandise at the second location, each item being provided on opposite sides thereof with information concerning corresponding available merchandise, and support means for holding said items in closely spaced high density concentration relative to one another so as to be individually visible while allowing each and every item to be manipulated by a customer to provide ready visual access to all the information on opposite sides of the item, said support means comprising an elongate support and a plurality of individual flexible members integral with said support means and cumulatively providing a length commensurate with that of said support means.

2. A system as defined in claim 1 wherein said support means is formed of material which is stiffer than the material from which said flexible members are formed.

3. A system as defined in claim 2 wherein said flexible members are in the form of webs.

4. A system as defined in claim 3 wherein said flexible members have free edges, said support means also including attaching means at the free edges of said flexible members.

5. A system as defined in claim 4 wherein said attaching means is formed of material which is stiffer than the material from which said flexible members are formed.

6. In a display assembly, integral support means of elongate form adapted to carry a plurality of substantially flat display packets bearing information on both sides thereof so that each display packet is capable of being manipulated relative to said support means so that a person may individually access both sides of each display packet, said support means comprising an elongate base portion of relatively rigid material adapted to be attached to a rigid surface, a plurality of separate attaching portions adapted to receive said display packets and each being of a length which is a fraction of the length of said base portion and cumulatively extending the length of said base portion, and flexible means of relatively flexible material for integrally but separately joining said base portion to said attaching portions.

7. In a display assembly as defined in claim 6 wherein said support means is an extrusion.

8. A system for displaying information relative to merchandise available for purchase or rental where selection of merchandise is accomplished through viewing of product information items each having merchandise information on both front and reverse faces thereof concerning corresponding merchandise products, said system comprising support means for supporting a plurality of product information items in an array where front faces of such product information items are open to view, said support means supporting said product information items in closely spaced high density concentration relative to one another and including attachment means for permitting individual manipulation of each product information item so that a reverse face thereof may be viewed, said support means comprising an elongate base portion of relatively rigid material adapted to be attached to a support, a plurality of separate carrying portions adapted to receive the items and each of a length which is a fraction of the length of said base portion, and an intermediate portion of relatively flexible material for integrally joining said base portion to said carrying portions to allow independent movement of each of said carrying portions by flexure of said intermediate portion.

9. A system as defined in claim 8 wherein said carrying portions are formed of a material having a flexibility intermediate between that of said intermediate portion and that of said base portion.

10. A system as defined in claim 9 wherein said base portion comprises flange means having parallel flange elements for detachably engaging a rail fixed to a wall.

11. A system as defined in any one of claims 8–10 wherein said support means is an extrusion of synthetic resinous material.

12. A merchandise identification system comprising a plurality of display items separate and remote from available merchandise and each item provided on opposite sides thereof with information concerning corresponding merchandise, and a plurality of separate support means for holding said items in rows and columns which are of high density, closely spaced relation in which the information on one side of each of the items is individually visible while allowing each and any item to be manipulated by a prospective purchaser for ready visual access to the information provided by the opposite side of each such item, each support means comprising a rigid base portion adapted to be attached to a support such as a wall, each base portion having first means for supporting a row of items in upstanding relation thereto and second means for supporting a row of items in suspended relation therefrom.

13. A merchandise identification system as defined in claim 12 wherein said first means comprises a channel for receiving lower edge portions of said items.

14. A merchandise identification system as defined in claim 13 including guide means for guiding an item inserted into said channel.

15. A merchandise identification system as defined in claim 14 wherein said guide means is a ramp integral with a wall of said channel and extending upwardly and rearwardly therefrom.

16. A merchandise identification system as defined in claim 12 wherein said first means supports said items in overlapping relation to said base portion and said second means suspends said items in spaced relation below said base portion.

17. A merchandise identification system comprising a plurality of display items at a first location sufficiently remote from a second location having available merchandise so that a customer at the first location does not have access to the merchandise at the second location, each item being provided on opposite sides thereof with information concerning corresponding available merchandise, and support means for holding said items in closely spaced high density concentration relative to one another so as to be individually visible while allowing each and every item to be manipulated by a customer to provide ready visual access to all the information on opposite sides of the item said support means including a first portion of relatively rigid material having means thereon for mounting the support means in operative position, said support means including a second portion of relatively flexible material integral with said first portion and extending along the length thereof, said second portion comprising a plurality of adjacent flexible webs, said webs having adjacent side edges spaced from one another, each of said webs having at the lower edge thereof attaching means for attaching a display item thereto in depending relationship therefrom so that one side of the display item is visible to a customer, the flexible webs permitting a customer to swing each display item upwardly about the associated flexible web to permit the customer to view the opposite side of the display item.

18. A merchandise identification system as defined in claim 17 wherein said first portion and said attaching means are each formed of a material which is stiffer than the material from which said second portion is formed.

19. A merchandise identification system as defined in claim 17 wherein said support means is an extrusion of synthetic resinous material.

20. A merchandise identification system comprising a plurality of display items at a first location sufficiently remote from a second location having available merchandise so that a customer at the first location does not have access to the merchandise at the second location, each item being provided on opposite sides thereof with information concerning corresponding merchandise, and support means for holding said items in closely spaced high density concentration relative to one another so as to be individually visible while allowing each and every item to be manipulated by a customer to provide ready visual access to all the information on opposite sides of the item, said support means comprising an elongate support and a plurality of individual flexible members integral with said support means and cumulatively providing a length commensurate with that of said support means, said support means being formed of a material which is stiffer than the material from which said flexible members are formed, said flexible members being in the form of webs, attaching means at the free edges of said flexible members, said attaching means being formed of material which is stiffer than the material from which said flexible members are formed, said attaching means being of longitudinally split tubular form.

21. A system as defined in claim 20 wherein said support means is in the form of an extrusion.

22. A merchandise identification system comprising a plurality of display items separate and remote from available merchandise and each item provided on opposite sides thereof with information concerning corresponding merchandise, and a plurality of separate support means for holding said items in rows and columns which are of high density, closely spaced relation in which the information on one side of each of the items is individually visible while allowing each and any time to be manipulated by a prospective purchaser for ready visual access to the information provided by the opposite side of each such item, each support means comprising a rigid base portion adapted to be attached to a support such as a wall, each base portion having first means for supporting a row of items in upstanding relation thereto and a second means for supporting a row of items in suspended relation therefrom, said first means comprising a channel for receiving lower edge portions of said items, said second means comprising a plurality of flexible webs depending from each said base portion and each web terminating in a lower edge providing releasable attaching means for carrying an individual item.

23. A merchandise identification system as defined in claim 22 wherein each attaching means comprises a longitudinally split tube.

24. A merchandise identification system as defined in claim 23 wherein said support means is an extrusion of synthetic resinous material.

25. A merchandise identification system as defined in claim 24 wherein said webs are more flexible than said base portion and said attaching means.

26. A merchandise identification system as defined in claim 25 wherein each said base portion is provided with parallel flanges for removably securing each such base portion to a wall-mounted rail.

27. A merchandise identification system comprising a plurality of display items at a first location sufficiently remote from a second location having available merchandise so that a customer at the first location does not have access to the merchandise at the second location, each item being provided on opposite sides thereof with information concerning corresponding available merchandise, and support means for holding said items in closely spaced high density concentration relative to one another so as to be individually visible while allowing each and every item to be manipulated by a customer to provide ready visual access to all the information on opposite sides of the item, said support means including a first portion of relatively rigid material having means thereon for mounting the support means in operative position, said support means including a second portion of relatively flexible material integral with said first portion and extending along the length thereof, said second portion comprising a plurality of adjacent flexible webs, said webs having adjacent side edges spaced from one another, each of said webs having at the lower edge thereof attaching means for attaching a display item thereto in depending relationship therefrom so that one side of the display item is visible to a customer, the flexible webs permitting a customer to swing each display item upwardly about the associated flexible web to permit the customer to view the opposite side of the display item, said attaching means being of longitudinally split tubular form.

28. A merchandise identification system comprising a plurality of display items at a first location sufficiently remote from a second location having available merchandise so that a customer at the first location does not have access to the merchandise at the second location, each item being provided on opposite sides thereof with information concerning corresponding available merchandise, and support means for holding said items in closely spaced high density concentration relative to one another so as to be individually visible while allowing each and every item to be manipulated by a customer to provide ready visual access to all the information on opposite sides of the item, said support means including a first portion of relatively rigid material having means thereon for mounting the support means in operative position, said support means including a second portion of relatively flexible material integral with said first portion and extending along the length thereof, said second portion comprising a plurality of adjacent flexible webs, said webs having adjacent side edges spaced from one another, each of said webs having at the lower edge thereof attaching means for attaching a display item thereto in depending relationship therefrom so that one side of the display item is visible to a customer, the flexible webs permitting a customer to swing each display item upwardly about the associated flexible web to permit the customer to view the opposite side of the display item, said support means including an integral upwardly facing channel for supporting the lower portions of items disposed in upstanding relation thereto.

29. A merchandise identification system comprising a plurality of display items separate and spaced from available merchandise and each item provided on opposite sides thereof with information concerning corresponding merchandise, and support means for holding said items in closely adjacent spaced relationship to one another so that one side of each of said items is visible to a prospective customer, said support means including a first portion adapted to be mounted in operative position, said support means including a second portion interconnected with said items in such a manner that a customer can move an item relative to the first portion while the item remains connected to said second portion into a position wherein the opposite side of the item is visible to a customer.

30. A merchandise identification system for use in stores which rent or sell prerecorded video tapes in cassette form disposed in a housing package normally having information concerning the enclosed cassette disposed on opposite sides of the housing package comprising, a plurality of product information modules separate and spaced from available cassettes, each module having opposite sides, said opposite sides having supported thereon information similar to that normally appearing on opposite sides of a conventional housing package for a video tape cassette to provide information to assist a prospective customer in making a choice, support means for supporting said modules in spaced relationship to one another and independently movable with respect to one another, said modules being disposed closely adjacent one another so that one side of each module is visible in a first position of each module, a large number of said modules being readily visible to a customer standing in one place proximate the modules, means for mounting said support means in operative position, and means on said support means for supporting said modules in said one position and allowing a customer to manipulate the module to a second position wherein the opposite side of the module is visible to the customer.

31. A system as defined in claim 30 wherein said support means for supporting said modules in said one position includes means interconnecting said modules with said support means so that each of said modules is swingable by a customer from said first position to said second position while each module remains interconnected with said support means.

* * * * *